US006145367A

United States Patent [19]

Peloquin et al.

[11] Patent Number: 6,145,367

[45] **Date of Patent: *Nov. 14, 2000**

[54] WORKPIECE HOLDER FOR PRESS BRAKE

[75] Inventors: Wayne F. Peloquin, Forest Lake, Minn.; David M. Runk, St. Joseph, Wis.

[73] Assignee: Wilson Tool International, Inc., White Bear Lake, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/310,772

[22] Filed: May 10, 1999

[51] Int. Cl.[7] ..... B21D 11/22

[52] U.S. Cl. ..... 72/461; 72/31.1; 72/31.12

[58] Field of Search ..... 72/461, 389.3, 72/31.1, 31.12; 83/462, 467.1, 468.1, 468.2, 468.7

[56] References Cited

U.S. PATENT DOCUMENTS

| | | | |
|---|---|---|---|
| 870,578 | 11/1907 | Nelson . | |
| 1,162,343 | 11/1915 | Curran et al. . | |
| 1,345,033 | 6/1920 | Stengel . | |
| 1,346,185 | 7/1920 | Eggers . | |
| 1,410,519 | 2/1922 | Stengel . | |
| 2,924,260 | 2/1960 | Guarino | 72/31.12 |
| 3,826,119 | 7/1974 | Marotto | 72/461 |
| 4,055,070 | 10/1977 | Wingate et al. . | |
| 4,411,150 | 10/1983 | Klein et al. | 72/461 |
| 4,494,312 | 1/1985 | Roch | 72/461 |
| 4,583,391 | 4/1986 | Stafford . | |
| 5,526,672 | 6/1996 | Cain et al. | 72/461 |

*Primary Examiner*—David Jones
*Attorney, Agent, or Firm*—Fredrikson & Byron, P. A.

[57] ABSTRACT

An adjustable gage block for a press brake comprises a base attachable to the press brake and a body pivotally carried by the base for pivoting movement about a vertical axis. The body carries a first guide member, and a second guide member is pivotally carried by the body for pivoting movement about said vertical axis with respect to the first guide member. One or both of the guide members have upwardly-facing guide surfaces laying in a horizontal plane to support a workpiece, and each guide member has a vertical guide surface, with the vertical guide surfaces laying in convergent planes. Adjustment means are provided for adjusting the angle between the vertical guide surfaces of the guide members to accommodate the shape of a workpiece. Desirably, a workpiece support is mounted to the press brake spaced from the gage block, the workpiece support having an edge guide surface positioned to engage an edge of the workpiece and to orient the workpiece with respect to the gage block.

16 Claims, 3 Drawing Sheets

WORKPIECE HOLDER FOR PRESS BRAKE

FIELD OF THE INVENTION

The present invention relates to press brakes of the type used to shape sheet-like metal workpieces, and particularly to workpiece holders employed to properly position a sheet-like workpiece between the tables of a press brake.

BACKGROUND OF THE INVENTION

Press brakes are equipped with movable lower and upper tables, sometimes referred to as jaws. Forming tools are mounted to the tables so that when the tables are brought together, a sheet-like workpiece between the forming tables is bent into an appropriate shape. Press brake tables commonly move in a vertical plane. Behind the plane of the tables of a press brake may be mounted a gage block having a forwardly-facing surface against which the edge of a workpiece is urged in order to properly position the workpiece for bending. Various gage blocks, sometimes called back gages, are shown in U.S. Pat. No. 1,346,185 (Eggers), U.S. Pat. No. 4,055,070 (Wingate, et al.), U.S. Pat. No. 4,583,391 (Stafford), and U.S. Pat. No. 5,526,672 (Cain, et al.).

Often, sheet metal workpiece shapes have edges that are oriented at other than right angles to the direction of the desired bend. One may employ a protractor device mounted to the press brake and that includes a straightedge along which the edge of the workpiece can be guided in a direction other than perpendicular to the press brake tables. Here, the angle of the straightedge with respect to the tables is adjusted until the correct angle is obtained, and the workpiece then is fed along the straightedge until the leading portion of the workpiece encounters a gage block behind the vertical plane within which the tables move.

Gage blocks commonly present flat, forwardly-facing bearing surfaces that are parallel to the plane within which the workpiece tables move. When a leading edge of a workpiece is urged against a gage block bearing surface at an acute or obtuse angle to that surface, the pressure of the workpiece against the surface tends to cause the workpiece to slip along the gage surface, resulting in inaccurate bends. The leading end of the workpiece in any event is generally unsupported except for its single point or line of contact with a gage block surface.

It would be desirable to provide a workpiece mounting system for a press brake that would enable the workpiece to be accurately positioned and supported between the tables of the press brake, without the likelihood that the workpiece will slip or otherwise become misaligned.

SUMMARY OF THE INVENTION

The present invention provides a workpiece holding system which enables workpieces to be securely and repeatedly held in a predetermined position between the tables of a press brake.

In one embodiment, the invention relates to an adjustable gage block for a press brake. The gage block comprises a base attachable to the press brake, and a body pivotally carried by the base for pivoting movement about a vertical axis with respect to the base. The body carries a first guide member. A second guide member is pivotally carried by the body for pivoting movement with respect to the first guide member about the same vertical axis. Each guide member has a generally vertical guide surface. In a preferred embodiment, the vertical guide surfaces define convergent planes that intersect along the above-mentioned vertical axis, and most preferably the vertical guide surfaces are planar. Adjustment means are provided for adjusting the included angle between the vertical surfaces of the guide members and the vertical axis to accommodate the shape of a workpiece. Desirably, the guide members are configured to provide an upwardly open workpiece-receiving recess through which the axis passes. Preferably, one or both guide members have upwardly-facing guide surfaces for supporting a sheet-like workpiece.

In another embodiment, the invention relates to a press brake having upper and lower tables, and cooperating workpiece positioning elements for positioning a sheet-like workpiece in a predetermined position between the tables. The press brake includes an adjustable gage block comprising a base attached to the press brake and a body pivotally carried by the base for pivoting movement about a vertical axis, the body carrying a first guide member. A second guide member is pivotally carried by the body for pivoting movement with respect to the first guide member about the same vertical axis so that the body and the guide members may pivot as a unit about the vertical axis with respect to the base. Each guide member has a vertical guide surface. Adjustment means are provided for adjusting the included angle between the vertical surfaces and the vertical axis so as to accommodate the shape of a workpiece, that is, the leading end portion of a workpiece. Preferably, one or both of the guide members also have an upwardly-facing guide surface for supporting a workpiece.

The workpiece positioning elements include a workpiece support mounted to the press brake, as by being clamped to a lower die of the press brake, and spaced from the gage block. The workpiece support has an edge guide surface positioned to engage an edge of a workpiece when the latter is in its predetermined position and supported by the gage block.

In yet another embodiment, the invention relates to a method for positioning a sheet-like workpiece between the tables of a press brake in a predetermined position. An adjustable gage block is provided, including a mounting base attached to the press brake. A body is pivotally carried by the base for pivoting movement about a vertical axis with respect to the base, the body carrying a first guide member. A second guide member is pivotally carried by the body for pivoting movement about the vertical axis with respect to the first guide member, so that the body and guide members may pivot as a unit with respect to the mounting base. Each guide member has a vertical guide surface. Adjustment means are provided for adjusting the included angle between the vertical surfaces and the vertical axis. Preferably, the vertical guide surfaces are planar, and define planes that intersect along the vertical axis.

The leading portion of a workpiece is supported between the vertical guide surfaces, and the angle between the vertical guide surfaces and the axis is adjusted so that each vertical guide surface contacts an edge of the workpiece. The workpiece and the supporting gage block are pivoted as a unit about said vertical axis to then position the workpiece in its predetermined position, the leading portion of the workpiece being continuously supported by the adjustable gage block. Preferably, one or both of the guide members has an upwardly-facing guide surface, and the workpiece is supported on the upwardly facing surface and between and in contact with the vertical guide surfaces.

The method desirably includes the step of providing a workpiece support mounted to the press brake and spaced from the gage block. The support has an edge guide surface position to engage an edge of the workpiece when the latter is in its predetermined position. Here, the method includes the step of pivoting the workpiece and the gage block supporting the leading portion thereof about the vertical axis until an edge of the workpiece engages the edge guide surface of the workpiece support, thereby positioning the workpiece in its predetermined, desired position.

DETAILED DESCRIPTION OF THE PREFERRED EMBODIMENT

Figure 1:
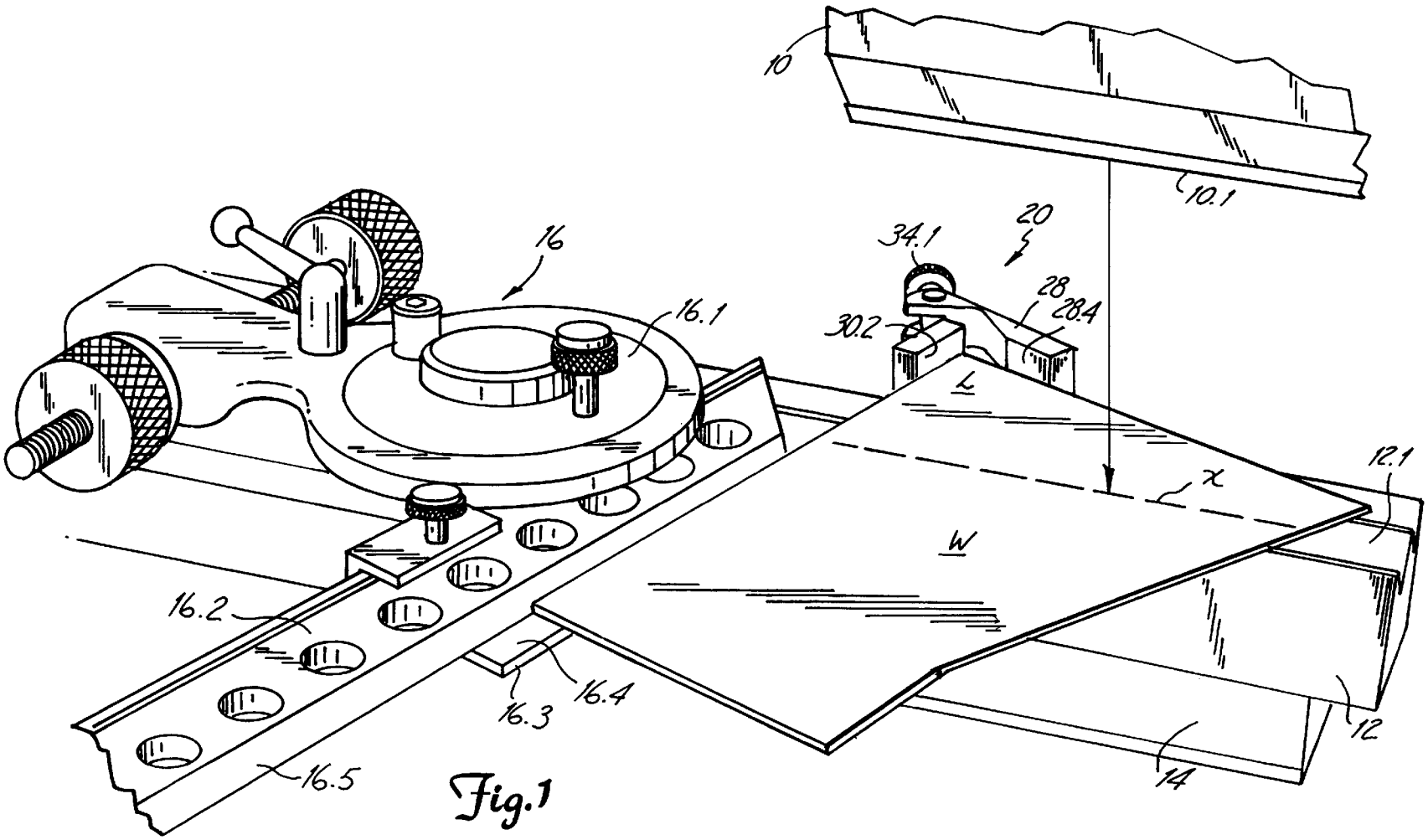
FIG. 1 is a broken-away, perspective view of a press brake to which are mounted an adjustable gage block and a workpiece support of the invention.

Referring first to FIG. 1, a shaping tool and die of a press brake are shown generally as 10 and 12. The upper portion of the tool 10 thus illustrated is mounted to the upper table or jaw (not shown) of a press brake, and has a downwardly-facing, lower edge 10.1 which may be generally "V" shaped. Tool 10 is positioned with its lower edge in vertical alignment with an upwardly-facing, generally "V" shaped recess 12.1 formed in the die 12, the die being mounted to the lower table or jaw 14 of the press brake. Various press brakes and shaping tools, as typified in the drawing, are well known in the field, and need no further description.

Figure 4:
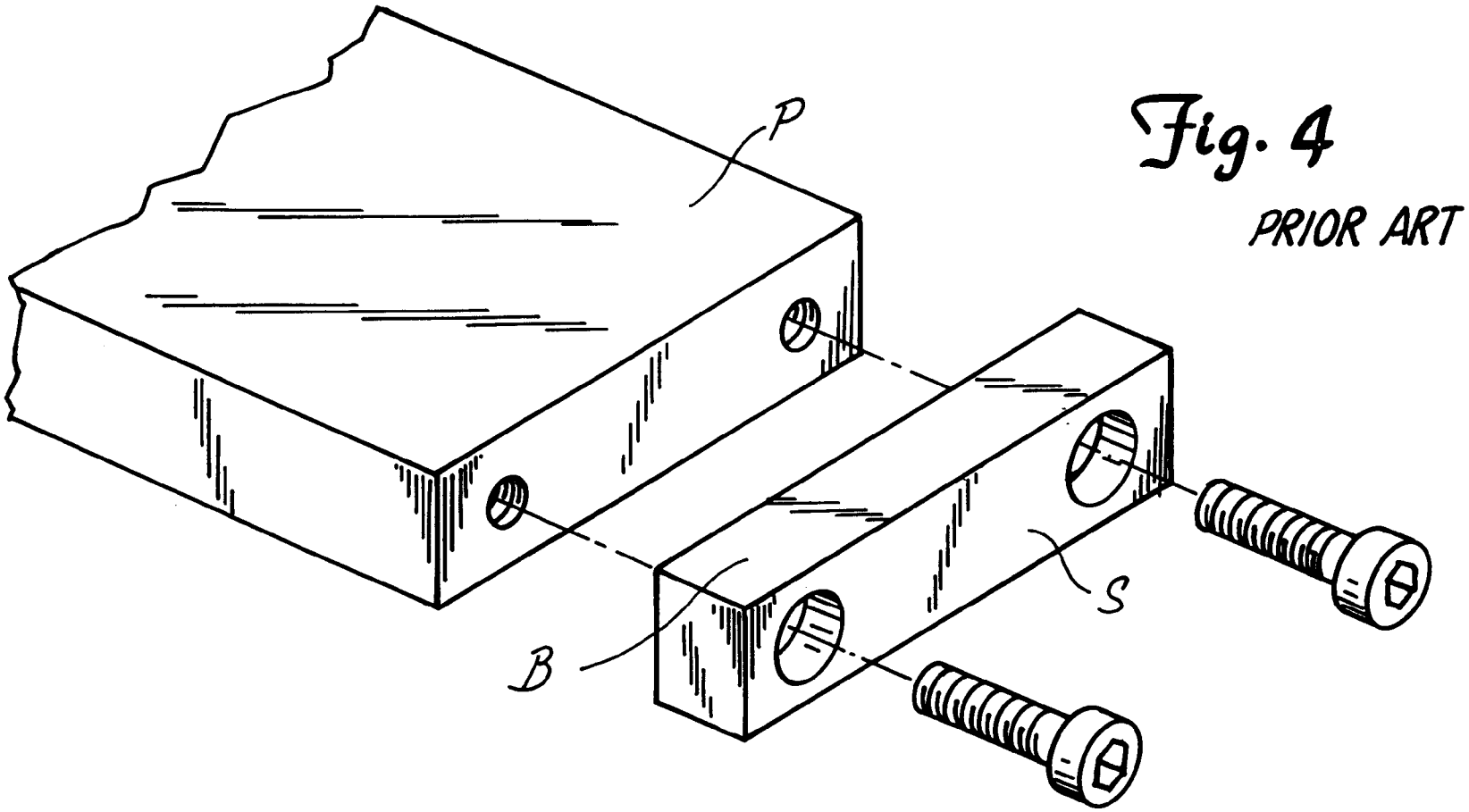
Fig. 4 PRIOR ART
FIG. 4 is a perspective, broken-away view of a prior art gage block.

Mounted to the lower die 12 of the press brake shown in FIG. 1 is an adjustable protractor 16 of known design. The protractor includes a rotatable disc 16.1 bearing a straight-edge guide 16.2, the latter including a plate 16.3 having an upper, horizontal, workpiece—supporting surface 16.4, and also a generally vertical edge 16.5 for supporting a sheet-like workpiece W, as shown in FIG. 1. Certain prior art devices utilize a protractor such as that described, in conjunction with a gage block such as that shown in FIG. 4, the latter consisting simply of a block B attached by screws to a mounting plate P carried by the press brake. As illustrated, the forwardly-facing gage surface S of the block B is parallel to the long direction of the upper and lower table of the press brake, that is, parallel to the vertical plane in which the tables move. As previously mentioned, if the straightedge guide 16.2 were positioned other than at a right angle to the face S, pressure of the workpiece at an angle against the gage block face would unfortunately tend to cause the workpiece to slip sideways.

Figure 3:
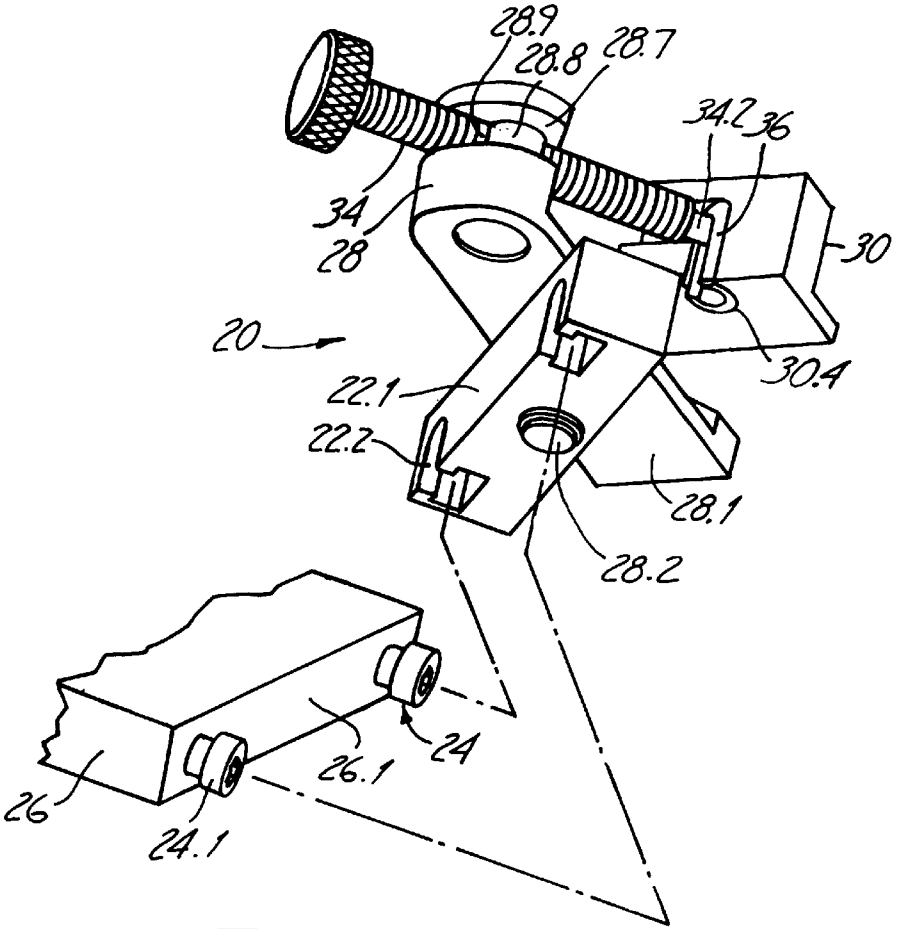
FIG. 3 is a different perspective view of the adjustable gage block shown in FIGS. 1 and 2, showing a manner of attachment of the gage block to a press brake.
Figure 2:
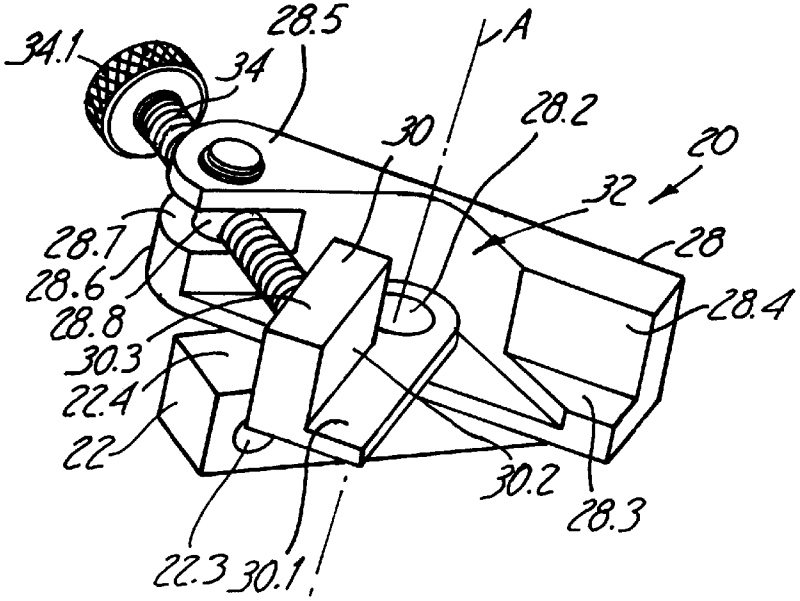
FIG. 2 is a perspective view of the adjustable gage block also shown in FIG. 1, taken from above the gage block.

An adjustable gage block is shown in FIGS. 1–3 as 20. The gage block includes a base 22 provided with a rear surface 22.1 having downwardly open recesses 22.2. The recesses are configured to receive the enlarged ends 24.1 of mounting elements 24 carried by the gage block mounting plate 26 of the press brake.

The mounting elements are depicted as screws 24 received in threaded holes in the mounting plate, enlarged heads of the screws providing the enlarged ends 24.1, and the screws being received in the holes so as to allow the enlarged heads to be spaced from the mounting place sufficiently to enable the heads to be snuggly received in the recesses 22.2 of the base. Holes 22.3 may be formed through the base in alignment with the recesses 22.2, as shown in FIG. 2, to provide screwdriver access to the screws so that the surface 22.1 of the base can be securely tightened to the forward face 26.1 of the mounting block 26.

An elongated body 28 with a generally flat bottom surface 28.1 is pivotally mounted to the base 22 by means of a pivot pin 28.2, the flat bottom surface of the body sliding upon the upper flat surface 22.4 of the base. One end portion of the body is formed with an upwardly-facing surface 28.3 and a vertical surface 28.4, this end portion of the body defining a first guide member. Pivotally mounted to the body by the pivot pin 28.2 is a second guide member 30, this guide member also having an upwardly-facing surface 30.1, lying in the same plane as the guide surface 28.3. The guide member 30 pivots about the same axis A with respect to the base 22 as does the body 28, the single pivot pin 28.2 holding the base, body and second guide member together.

Desirably, the two vertical guide surfaces 30.2, 28.4 define respective planes that intersect along and define the vertical axis A, regardless of the included angle between the two vertical surfaces and the axis. For ease of description, the vertical guide surfaces 28.4, 30.2 are depicted as being flat and lying in intersecting planes. It will be understood that these surfaces may be curved as desired, e.g., they may take the form of upwardly extending pins extending through the respective upwardly-facing surfaces 28.3, 30.1. Similarly, the upwardly-facing surfaces 28.3, 30.1 of the guide members need not necessarily lie in a horizontal plane, but may only have upwardly-facing portions upon which the leading end portion of the workpiece may be rested. As desired, only one of the guide members may have an upwardly facing surface, or the upwardly facing surfaces may be omitted entirely. In the preferred embodiment, the vertical guide surfaces are planar, enabling them to come into line contact with straight edges of workpieces at their leading ends, and desirably the vertical guide surfaces merge at right angles with the upwardly facing surfaces.

Referring again to FIG. 2, the vertical surfaces 30.2, 28.4 do not extend all the way to the axis A, but rather terminate short of the axis, providing an upwardly open, workpiece-receiving recess shown generally as 32, the vertical axis A extending upwardly through this recess and the recess providing space for reception of the leading end portion of a workpiece.

Various mechanisms may be employed to vary or adjust the included angle between the vertical surfaces 28.4, 30.2 of the guide members and the axis A. For example, a plate (not shown) may be mounted over the upper surface 30.3 of the guide member 30 and the upper surface 28.5 of the other end portion 28.6 of the body 28, the plate having a series of holes in it through which mounting screws may be threaded into the respective surfaces 30.3, 28.5 to hold the vertical surfaces of the guide members at any of several included angles.

The adjustment mechanism shown in FIGS. 2 and 3 has given good results. The end portion 28.6 of the body 28 is formed with a horizontally extending slot 28.7, and a pivot pin 28.8 extends vertically through the slot. Pivot pin 28.8 has a transverse threaded bore 28.9 (FIG. 3) through which extends a threaded shaft 34. The shaft at one end is provided with a manual adjustment knob 34.1. At its other end, the threaded shank is provided with a short, unthreaded portion 34.2 terminating in a ball, the latter being received in a slotted, downwardly open bushing 36 pivotally mounted in a cylindrical recess 30.4 formed in the second guide member 30, as best shown in FIG. 3. As the shaft 34 is rotated about its axis, it causes the second guide member 30 to pivot about the axis A with respect to the body 28, thus varying the included angle between the vertical guide surfaces 28.4, 30.2 and the axis A. The slotted bushing 36 rotates within the recess 30.4 and the pivot pin 28.8 rotates with respect to the body 28 as the angle between the vertical guide surfaces is changed.

Referring to FIG. 1 again, the forward or leading portion L of the workpiece W is supported on the upwardly-facing guide surfaces 30.1, 28.3 of the adjustable guide block 20, and the knob 34.1 is turned as needed until the vertical surfaces 28.4, 30.2 of the guide members come into contact with the edges of the workpiece. The desired angle of the straightedge 16.5 with respect to the long direction of the die 12 is selected and set, using the appropriate adjusting and clamping knobs, and the position of the protractor 16 along the bed 14 of the press brake is adjusted until the edge of the workpiece lies along and in contact with the straightedge and the leading portion of the workpiece is received in contact between the vertical guide surfaces 28.4, 30.2 of the adjustable gage block. In this position, a series of similarly shaped workpieces W can be introduced one-by-one between the jaws of the press brake for bending along the line indicated as X in FIG. 1, each workpiece having its leading end portion in contact with the vertical guide surfaces and resting upon the upwardly-facing guide surfaces of the gage block, an edge of the workpiece also lying along the straightedge 16.5.

If it is desired to change the angle of the bend line X, one need merely adjust the position and angle of the straightedge 16.5, since the body of the gage block will pivot about the axis A as is needed to retain the leading end of the workpiece. In place of the protractor 16, of course, may be employed any appropriate gage surface that can be engaged by the edge of the workpiece. For example, one may employ a vertical pin carried by the protractor 16, the pin having a vertical surface positioned to contact the workpiece when the workpiece is in the desired position for bending.

While a preferred embodiment of the present invention has been described, it should be understood that various changes, adaptations and modifications may be made therein without departing from the spirit of the invention and the scope of the appended claims.

What is claimed is:

1. Adjustable gage block for a press brake, comprising a. a base attachable to the press brake, b. a body pivotally carried by the base for pivoting movement about a vertical axis with respect to the base, the body carrying a first guide member;

c. a second guide member pivotally carried by said body for pivoting movement about said vertical axis with respect to said first guide member; each guide member having a vertical guide surface, the guide surfaces defining, with said axis, an included angle, and d. adjustment means for adjusting said included angle to accommodate the shape of a workpiece.

2. The adjustable gage block of claim 1 wherein said vertical surfaces terminate short of said vertical axis.

3. The adjustable gage block of claim 1 wherein at least one of said guide members includes an upwardly facing guide surface for supporting a workpiece.

4. The adjustable gage block of claim 1 wherein said vertical surfaces define planes converging along said vertical axis.

5. The adjustable gage block of claim 1 wherein said adjustment means comprises an elongated threaded member threadingly attached to one of said guide members and rotationally attached to the other guide member to adjust said included angle in response to rotation of said threaded member.

6. The adjustable gage block of claim 3 wherein said guide members are configured to provide an upwardly open workpiece-receiving recess extending upwardly from said upwardly facing guide surface and through which said axis passes.

7. The adjustable gage block of claim 1 wherein said base includes attachment means for attachment thereof to a press brake.

8. Adjustable gage block for a press brake having upper and lower tables, comprising a. a base attachable to the press brake, b. a body pivotally carried by the base for pivoting movement about a vertical axis with respect to the base, the body carrying a first guide member;

c. a second guide member pivotally carried by said body for pivoting movement about said vertical axis with respect to said first guide member; at least one of said guide members having an upwardly-facing guide surface for supporting a workpiece and each guide member having a vertical guide surface defining a plane, said planes intersecting along said axis and said guide members being configured to provide an open workpiece-receiving recess extending upwardly from between said planes and through which said vertical axis passes; and d. manually operable adjustment means for adjusting the included angle between the vertical surfaces of said guide members to accommodate the shape of a workpiece.

9. A press brake having parallel upper and lower tables, and cooperating workpiece positioning elements for positioning a sheet-like workpiece in a predetermined position between said tables, said elements comprising a. an adjustable gage block comprising a base attached to the press brake, a body pivotally carried by the base for pivoting movement about a vertical axis, the body carrying a first guide member; a second guide member pivotally carried by said body for pivoting movement about said vertical axis with respect to said first guide member; said guide members each having a vertical guide surface, whereby said body and guide members may pivot as a unit about said vertical axis with respect to said base; and adjustment means for adjusting the included angle between the vertical surfaces of said guide members and said axis to accommodate the shape of a workpiece, and b. a workpiece support mounted to the press brake and spaced from said gage block, the workpiece support having an edge guide surface positioned to engage an edge of a workpiece when the latter is in its predetermined position and supported by said gage block vertical guide surfaces.

10. The press brake of claim 9 wherein said vertical guide surfaces are planar and define planes converging along said vertical axis.

11. The press brake of claim 9 wherein said workpiece support comprises a base support attached to the press brake, and an elongated guide bearing said edge guide surface and pivotally attached to the base support for rotation about a vertical axis.

12. The press brake of claim 11 including means for adjusting the position of the base support in a direction parallel to the tables.

13. The press brake of claim 9 wherein at least one of said guide members includes an upwardly facing guide surface for supporting a workpiece.

14. Method of positioning a sheet-like workpiece between the tables of a press brake in a predetermined position, comprising:

a. providing an adjustable gage block including a base attached to the press brake, a body pivotally carried by the base for pivoting movement about a vertical axis with respect to the base, the body carrying a first guide member; a second guide member pivotally carried by said body for pivoting movement about said vertical axis with respect to said first guide member; each guide member having a vertical guide surface, and adjustment means for adjusting the included angle between the vertical surfaces of said guide members and said axis to accommodate the shape of a leading portion of the workpiece, b. orienting the leading portion of the workpiece between said vertical guide surfaces and adjusting said adjustment means so that said vertical guide surfaces each contact an edge of said leading portion; and c. pivoting said workpiece and said supporting gage block about said vertical axis to said predetermined position.

15. The method of claim 14 wherein at least one of said guide members has upwardly-facing guide surface, the method including the step of supporting said workpiece on said upwardly facing surface.

16. The method of claim 14 including providing a workpiece support mounted to the press brake, the support having an edge guide surface positioned to engage an edge of the workpiece when the latter is in its predetermined position, and wherein step (c) comprises pivoting said workpiece and supporting gage block body and guide members about said vertical axis to engage the workpiece edge with said edge guide surface.

* * * * *